US007080614B2

(12) United States Patent
Rauch et al.

(10) Patent No.: US 7,080,614 B2
(45) Date of Patent: Jul. 25, 2006

(54) HYDRAULICALLY ACTUATED, VARIABLE VALVE DRIVE OF AN INTERNAL COMBUSTION ENGINE

(75) Inventors: Martin Rauch, Bamberg (DE); Michael Haas, Weisendorf (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/999,247

(22) Filed: Nov. 30, 2004

(65) Prior Publication Data

US 2005/0126523 A1 Jun. 16, 2005

Related U.S. Application Data

(63) Continuation of application No. PCT/EP03/05014, filed on May 14, 2003.

(30) Foreign Application Priority Data

May 31, 2002 (DE) ..... 102 24 039

(51) Int. Cl.
*F01F 1/34* (2006.01)

(52) U.S. Cl. ..... 123/90.15; 123/90.12; 123/90.16

(58) Field of Classification Search ..... 123/90.12, 123/90.15, 90.16, 90.17, 90.31, 90.49, 90.55
See application file for complete search history.

(56) References Cited

U.S. PATENT DOCUMENTS

| | | | |
|---|---|---|---|
| 4,258,672 A | 3/1981 | Hietikko | |
| 5,954,020 A | 9/1999 | Schmidt et al. | |
| 6,412,457 B1 * | 7/2002 | Vorih et al. | 123/90.12 |

FOREIGN PATENT DOCUMENTS

| | | |
|---|---|---|
| DE | 42 24 988 | 2/1993 |
| EP | 0 535 275 | 4/1993 |
| EP | 0 803 642 | 10/1997 |
| EP | 1 091 097 | 4/2001 |
| EP | 1 245 799 | 10/2002 |
| WO | WO 89/02975 | 4/1989 |
| WO | WO 99/10629 | 3/1999 |

* cited by examiner

*Primary Examiner*—Thomas Denion
*Assistant Examiner*—Zelalem Eshete
(74) *Attorney, Agent, or Firm*—Volpe and Koenig, P.C.

(57) ABSTRACT

A hydraulically actuated, preferably variable, valve drive of an internal-combustion engine is provided, with a slave unit (15), which is embodied as a separate component relative to a master unit. A special characteristic is that the slave unit is provided with a hydraulic backlash compensation element (9), which is connected to a path (12) for feeding hydraulic medium only outside of a stroke phase of a slave piston (5). As a result, on one hand an easy-to-produce valve drive with slave unit (15) is provided. On the other hand, unnecessary "pumping up" of the backlash compensation element (9) during the stroke phases of the slave piston (5) is prevented by the previously mentioned admission of hydraulic medium.

12 Claims, 2 Drawing Sheets

HYDRAULICALLY ACTUATED, VARIABLE VALVE DRIVE OF AN INTERNAL COMBUSTION ENGINE

FIELD OF THE INVENTION

The invention relates to a hydraulically actuated, preferably variable, valve drive of an internal combustion engine, with a housing installed in a receptacle of a cylinder head. A slave piston, which can move in the axial direction, which defines a pressure chamber for the hydraulic medium on one of its ends, and which has a hydraulic backlash compensation element with a non-return valve on its other end, runs in the bore hole of this housing. The backlash compensation element acts at least indirectly on a gas-exchange valve on its side away from the housing, wherein the housing is sectioned by at least one path for hydraulic medium. This path is connected to a channel of the slave piston or backlash compensation element for further guidance of the hydraulic medium to a reservoir of the backlash compensation element directly in front of the non-return valve.

BACKGROUND

A valve drive of this general type is known from the class-forming WO 89/02975. On one hand, it should be stressed that this valve drive is relatively complicated to produce. The master and slave pistons have a common housing. Consequently, this valve drive is built, if necessary, relatively tall or its variability in use is limited. On the other hand, it should also be stressed that the hydraulic backlash compensation element is in permanent hydraulic medium contact with a feed line from the cylinder head. Due to this constant feeding with hydraulic medium, in the most unfavorable case, the backlash compensation element can be unnecessarily "pumped up" outside of the cam base-circle phases and thus undesired stroke changes on the gas-exchange valve can occur.

SUMMARY

Therefore, the object of the invention is to create a valve drive with a slave piston of the previously mentioned type, for which the cited disadvantages are eliminated.

This objective is solved according to the invention in that the housing installed in the cylinder head is produced as a separate component for forming only one slave unit, wherein the channel is connected hydraulically to the path only outside of a stroke phase of the slave piston.

In this way, the disadvantages mentioned in the introduction are effectively avoided. Consequently, on one hand a slave piston is provided, which has a "separate" housing, which is separated from the housing of the master piston. This permits the overall structural height of the valve drive to be reduced, if necessary. Simultaneously, the backlash compensation element is supplied hydraulically based on the measures in accordance with the invention only in a base-circle phase of the driving cam, where it is used in a known way for re-feeding the small amount of hydraulic medium discharged from a high-pressure chamber of the backlash compensation element during a high-pressure phase.

In addition, it should be stressed that the proposed valve drive with slave piston is relatively easy to produce.

Through the additional measures according to the invention, which optionally, in connection with the measures of the preamble, could also be worthy of protection by themselves, according to which a backlash compensation element is to be installed, which is taken completely from the construction kit for backlash compensation elements of non-switchable valve drives, further advantageous teaching how to further reduce the construction costs of the valve drive becomes obvious to one skilled in the art. Consequently, absolutely no changes to the machines and tools, which as a rule are extremely cost-intensive, must be performed in the production of conventional backlash compensation elements. The parts are practically immediately on hand. However, it is clear that, if necessary, slight adaptations to the previously used hydraulic backlash compensation elements known sufficiently to the technical world can be performed.

Through the separate configuration of the backlash compensation element and the slave piston, wherein these parts are to merely border each other at the ends in a refinement of the invention, further possibilities in the direction of minimizing the production costs are provided. However, it is also conceivable that both components are to be configured as one unit.

Further aspects of the invention relate to advantageous arrangements and configurations of the backlash compensation element on the slave piston. Even for the variants, for which previously used hydraulic elements are to be used as much as possible, a stop part can be installed at the end in the slave piston, which is overlapped in sections by a housing of the backlash compensation element in the compensating case. Here, an outer casing of the stop part is configured as the sliding surface for a bore hole of a housing of the backlash compensation element and simultaneously an annular space/channel is formed for feeding the hydraulic medium to a reservoir of the backlash compensation element between the outer casing and the bore hole of the housing of the slave piston. According to the invention, this annular space is connected to a path for feeding the hydraulic medium through the housing only during the base-circle passage, thus outside of a stroke phase of the slave piston. If necessary, the annular space can also already be in fluid connection with the path directly at the beginning of the stroke or before the end of the stroke.

According to a preferred refinement of the invention, the pressure piston of the backlash compensation element is to be applied in a bore hole of the slave piston. If necessary, this measure has advantages related to installation space and manufacturing.

Provided that it creates the compression spring installed in the backlash compensation element, which returns the slave piston at the stroke end in the available base-circle interval sufficiently fast, i.e., also at high rpm values of the internal-combustion engine, into its absolute end position, this does not need to be changed. However, it may also be desirable to use this spring, if necessary, with reinforcement or to apply a spring assembly. For example, as the spring assembly, for one, the compression spring in the backlash compensation element and simultaneously an external spring can be used, wherein the latter sits on one side on an axial extension of the pressure piston of the backlash compensation element axial extension of the pressure piston of the backlash compensation element extending in the valve direction and on the other hand acts against a facing end of the slave piston.

Instead of the illustrated helical springs, however, other spring means of a mechanical or other construction common to someone skilled in the art can also be used.

The non-return valve of the backlash compensation element can also be applied in a base of the end bore hole of the slave channel according to another aspect of the invention, wherein simultaneously the pressure piston encloses the high-pressure chamber of the backlash compensation element between the base and its facing end surface.

In addition, the path through the housing for feeding the hydraulic medium is allowed to open radially inwards into an annular groove. Thus, rotational securing devices of the slave piston can be eliminated. If necessary, the annular groove can also be arranged on the outer casing of the slave piston.

As the hydraulic medium for pressurizing the valve drive, any type of servo medium is conceivable and provided. However, primarily motor oil is imagined, which is otherwise present in the cycle of the internal-combustion engine, but servo mediums, such as brake fluid or the like, can also be conceivable for use.

Finally, the housing is to be connected to the cylinder head by means of a simple threaded connection. This is not provided in the state of the art mentioned in introduction above. Here, the housing, which disadvantageously leads simultaneously to the master and slave pistons, is arranged in the cylinder head by means of a force fit or the like.

BRIEF DESCRIPTION OF THE DRAWINGS

The invention is explained in more detail below with reference to the drawings. In the drawings.

DETAILED DESCRIPTION OF THE PREFERRED EMBODIMENTS

Figure 3:
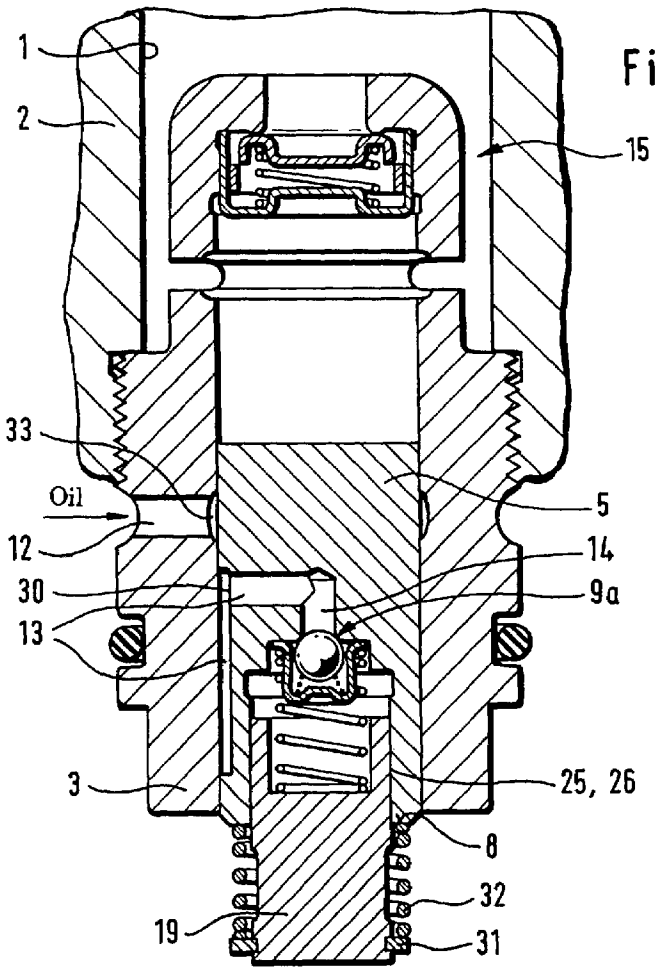

Partially represented in FIG. 3 is a cylinder head 2 with a receptacle 1. A housing 3 (see also the other figures) of a slave unit 15 according to the invention is screwed into this receptacle 1. The housing 3 has a bore hole 4, in which a slave piston 5 is held.

The fundamental layout and the function of a hydraulic valve drive, as well as a description of its master side, will not be discussed at this point, because these are sufficiently well known to the state of the art.

The slave piston 5 defines in the region of one of its ends 6 a pressure chamber 7 for hydraulic medium. On its other end 8, it has a bore hole 16, in which a stop part 17 is installed. This projects out of the bore hole 16. An annular space 24 for hydraulic medium is formed between an outer casing 20 and the bore hole 4. Simultaneously, an edge region of a surface 18 of the stop part 17 has a recess 23 for the hydraulic medium for direct feeding of this medium into a reservoir 14 of a backlash compensation element 9.

Figure 1:
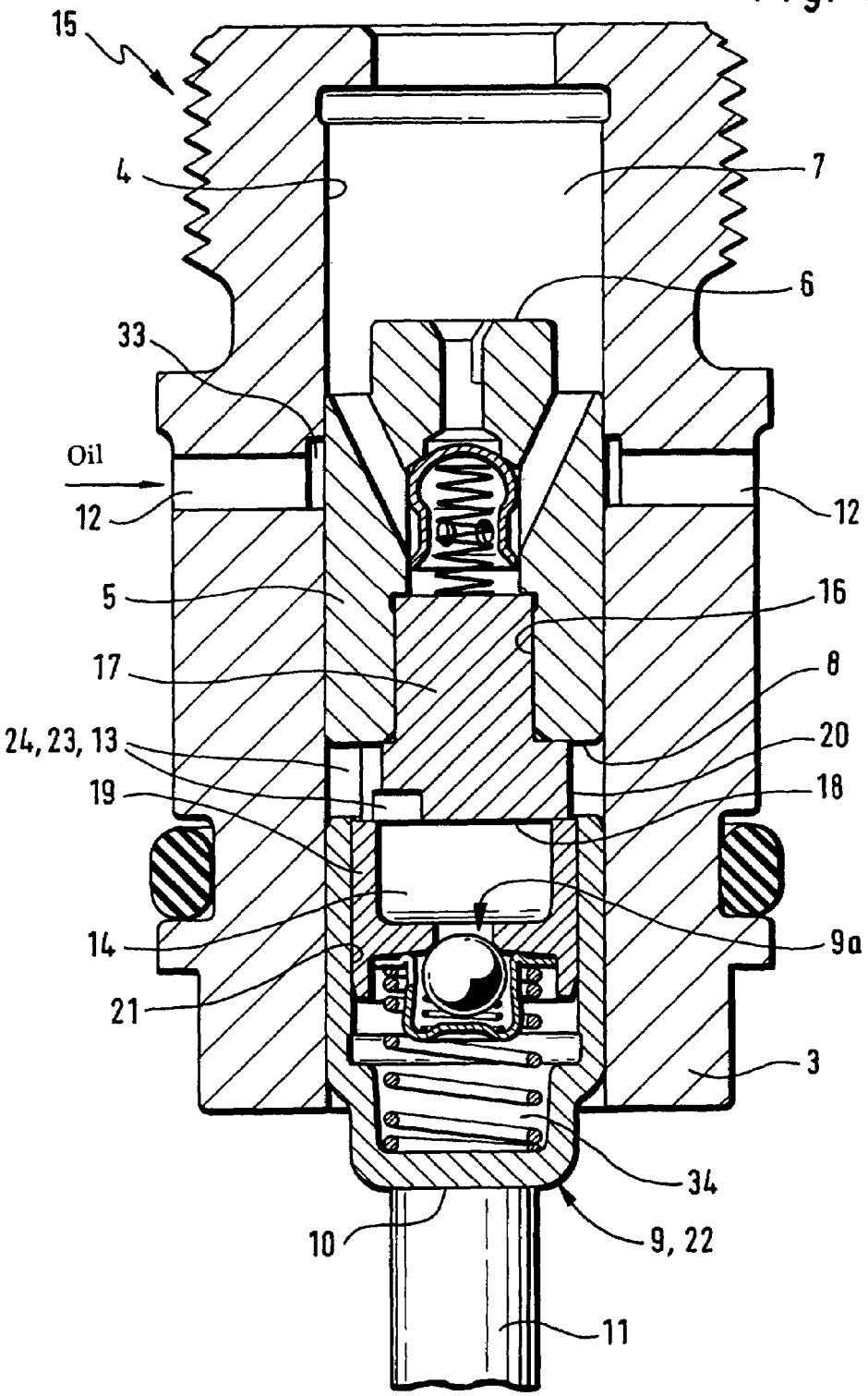
FIGS. 1 to 3 are section views showing a variable valve drive of an internal-combustion engine having slave units according to the invention.

From FIG. 1, it can also be seen that a pressure piston 19, which encloses the previously mentioned reservoir 14 and always contacts the surface 18 at the end, runs within a bore hole 21 of the housing 22. When backlash compensation is needed during a cam stroke phase, the pressure piston 19 overlaps the outer casing 20 of the stop part 17.

In addition, it can be seen that in FIG. 1, there are two diametrically opposite paths 12 for feeding hydraulic medium. Here, the paths 12 open radially inwards into an annular groove 33. The path 12 with annular groove 33 is in fluid connection with the channel 13 for feeding the hydraulic medium via the recess 23 into the reservoir 14 (FIG. 1) only during a base-circle passage of the impinging cam, i.e., outside of a stroke movement of the slave piston 5. This avoids unnecessary "pumping up" of the backlash compensation element 9 outside of the base-circle phase with the disadvantages sufficiently known to the technical world. Still to be mentioned is that a non-return valve 9*a*, which opens in the direction towards a high-pressure space 34 lying underneath, is arranged on the pressure piston 19 on the valve side according to FIG. 1.

The slave piston 5 and the backlash compensation element 9 according to FIG. 1 are produced as completely separated components. However, this is not the case for the embodiment according to FIG. 2. Here, the slave piston 5 has a bore hole 25 going out from its other end 8. The pressure piston 19 of the backlash compensation element 9 runs in this bore hole. A leakage slot for the hydraulic medium is formed between the bore hole 25 and an outer casing of the pressure piston 19. Simultaneously, the pressure piston 19 (one-part or two-part) extends in the valve direction by a projection piece 27. On the valve side, the latter has a radial extension 28, which is connected here integrally to the projection piece 27, on which on one end a compression spring 29 is supported. The compression spring 29 acts on the other end against the end 8 of the slave piston 5. This effectively enables the return movement of the slave piston 5 at the stroke end up to its fixed end position. If necessary, if the force of the compression spring 35 allocated to the backlash compensation element 9 is sufficient, such a separate compression spring 29 can also be eliminated.

A feed of the hydraulic medium is achieved here in turn through at least one path 12 through the housing 3, which opens radially inwards into the annular groove 33. During the base-circle passage, the path 12 with the annular groove 33 is connected to a channel 13 in the slave piston 5 embodied as a radial passage. From the channel 13 outwards, the hydraulic medium is led to a "reservoir 14" in the projection piece 27 and from there directly to the non-return valve 9*a* using means and methods not to be described in more detail.

Figure 2:
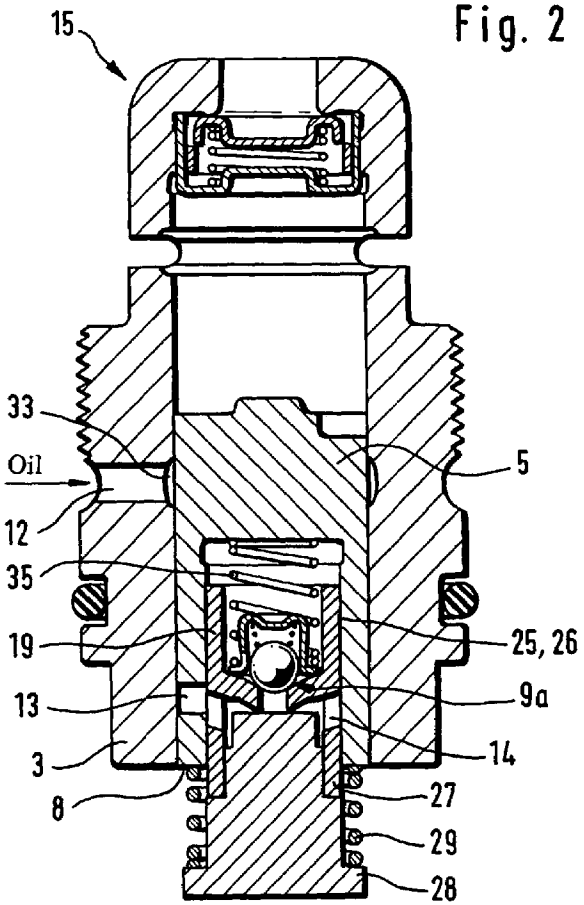

Similar to that described in FIG. 2, the slave piston 5 according to FIG. 3 likewise has a bore hole 25 on its other end 8. The pressure piston 19 is installed in the bore hole 25. In turn, the leakage slot 26 for the hydraulic medium is formed between the bore hole 25 of the slave piston 5 and an outer casing of the pressure piston 19. Simultaneously, it can be seen from FIG. 3 that the non-return valve 9*a* is here arranged on a base of the bore hole 25. A feed for the hydraulic medium up to directly before the non-return valve 9*a*, which opens here in the valve direction, is realized in turn via at least one path 12 extending radially through the housing 3 with radially inner annular groove 33. For further guidance of the hydraulic medium from the annular groove 33 outwards, the slave piston 5 has a channel 13, which is produced as a longitudinal groove in the outer casing of the slave piston 5, on the side of the path 12. Branching from the longitudinal groove is a radial section, which in turn goes into an axial channel, which is designated here with "reservoir 14."

In addition, it can be seen that the pressure piston 19 is enclosed by a compression spring 32, which acts on one end against a radial extension 31 embodied here as a securing ring and on the other end is supported on the other end 8 of the slave piston 5.

In all of the figures, the slave piston 5 is shown in its valve stroke position, which can be the maximum stroke.

LIST OF REFERENCE SYMBOLS

1 Receptacle
2 Cylinder head
3 Housing

4 Bore hole
5 Slave piston
6 One end
7 Pressure chamber
8 End
9 Backlash compensation element
9*a* Non-return valve
10 Side
11 Gas-exchange valve
12 Path
13 Channel
14 Reservoir
15 Slave unit
16 Bore hole
17 Stop part
18 Surface
19 Pressure piston
20 Outer casing
21 Bore hole
22 Housing
23 Recess
24 Annular space
25 Bore hole
26 Leakage slot
27 Projection Piece
28 Radial extension
29 Compression spring
30 Inlet
31 Radial Extension
32 Compression spring
33 Annular groove
34 High-pressure chamber
35 Compression spring

The invention claimed is:

1. Hydraulically actuated variable valve drive of an internal-combustion engine, comprising a housing (3) installed in a receptacle (1) of a cylinder head (2), the housing includes a bore hole (4) in which an axially moveable slave piston (5) is located, the slave piston includes on one end (6) a pressure chamber (7) for the hydraulic medium and on an other end (8) has a hydraulic backlash compensation element (9) with a non-return valve (9*a*), the backlash compensation element (9) is adapted to act at least indirectly on a gas-exchange valve (11) on a side (10) of the compensation element away from the housing, wherein the housing (3) is sectioned by at least one path (12) for hydraulic medium, with the path being connected to a channel (13) of the slave piston (5) or the backlash compensation element (9) for further guidance of the hydraulic medium to a reservoir (14) of the backlash compensation element (9) directly in front of the non-return valve (9*a*), the housing (3) installed in the cylinder head (2) is produced as a separate component for forming only one slave unit (15), the channel (13) is connected hydraulically to the path (12) only outside of a stroke phase of the slave piston (5), and the backlash compensation element (9) and the slave piston (5) form materially separate units, which border each at the most on axially adjacent ends thereof, wherein the backlash compensation element (9) comprises a pressure piston (19) with the non-return valve (9*a*) and with the reservoir (14) and a housing (22) with a bore hole (21), within which the pressure piston (19) runs.

2. Hydraulically actuated variable valve drive of an internal-combustion engine, comprising a housing (3) installed in a receptacle (1) of a cylinder head (2), the housing includes a bore hole (4) in which an axially moveable slave piston (5) is located, the slave piston includes on one end (6) a pressure chamber (7) for the hydraulic medium and on an other end (8) has a hydraulic backlash compensation element (9) with a non-return valve (9*a*), the backlash compensation element (9) is adapted to act at least indirectly on a gas-exchange valve (11) on a side (10) of the compensation element away from the housing, wherein the housing (3) is sectioned by at least one path (12) for hydraulic medium, with the path being connected to a channel (13) of the slave piston (5) or the backlash compensation element (9) for further guidance of the hydraulic medium to a reservoir (14) of the backlash compensation element (9) directly in front of the non-return valve (9*a*), the housing (3) installed in the cylinder head (2) is produced as a separate component for forming only one slave unit (15), the channel (13) is connected hydraulically to the path (12) only outside of a stroke phase of the slave piston (5), the other end (8) of the slave piston (5) has a bore hole (25), in which a pressure piston (19) of the backlash compensation element (9) with the non-return valve (9*a*) runs, wherein between the bore hole (25) and an outer casing of the pressure piston (19), a leakage slot (26) for the hydraulic medium is formed, the slave piston (5) has on an axial section of the bore hole (25) at least one passage as a component of the channel (13) for the hydraulic medium, with the at least one passage being in direct fluid connection with the path (12) outside of the stroke phase of the slave piston (5).

3. Valve drive according to claim 2, wherein the backlash compensation element (9) is installed, which is formed at least in a majority from a construction kit for backlash compensation elements of non-switchable valve drives.

4. Valve drive according to claim 2, wherein the pressure piston (19) has a projection piece (27) that extends in a valve direction or is connected to such a piece, which on one end acts directly on the gas-exchange valve (11), wherein a radial extension (28), such as an annular shoulder or a separate securing ring, extends out from the projection piece (27), on which a compression spring (29) is supported, with the spring acting against the slave piston (5) on an other end thereof.

5. Valve drive according to claim 4, wherein the projection piece (27) and the pressure piston (19) are produced as separate parts.

6. Valve drive according to claim 2, wherein the path (12) opens into an annular groove (33) in the bore hole (4) of the housing (3), from which hydraulic medium is supplied from the channel (13).

7. Hydraulically actuated variable valve drive of an internal-combustion engine, comprising a housing (3) installed in a receptacle (1) of a cylinder head (2), the housing includes a bore hole (4) in which an axially moveable slave piston (5) is located, the slave piston includes on one end (6) a pressure chamber (7) for the hydraulic medium and on an other end (8) has a hydraulic backlash compensation element (9) with a non-return valve (9*a*), the backlash compensation element (9) is adapted to act at least indirectly on a gas-exchange valve (11) on a side (10) of the compensation element away from the housing, wherein the housing (3) is sectioned by at least one path (12) for hydraulic medium, with the path being connected to a channel (13) of the slave piston (5) or the backlash compensation element (9) for further guidance of the hydraulic medium to a reservoir (14) of the backlash compensation element (9) directly in front of the non-return valve (9*a*), the housing (3) installed in the cylinder head (2) is produced as a separate component for forming only one slave unit (15), the channel (13) is connected hydraulically to the path (12) only outside of a stroke phase of the slave piston (5), the other end (8) of the slave piston (5) has a bore hole (16), in which a stop part (17) projecting from the hole is installed, the stop part having a surface (18) facing the backlash compensation element (9) that contacts a pressure piston (19) of the backlash compensation element (9) enclosing the reservoir (14), an outer casing (20) of the stop part (17) is produced as a sliding surface for a bore hole (21) of a housing (22) of the backlash compensation element (9), the surface (18) at the edge or the pressure piston (19) at its edge or both elements (18, 19) have in common at least one recess (23) as an overflow for the hydraulic medium from an annular space (24) for the hydraulic medium lying between the outer casing (20) of the projecting stop part (17) and the bore hole (21) of the housing (22) as a component of the channel (13) leading into the reservoir (14) of the pressure piston (19), with the annular space (24) being in direct fluid connection with the path (12) outside of the stroke phase of the slave piston (5).

8. Valve drive according to claim 7, wherein the path (12) opens into an annular groove (33) in the bore hole (4) of the housing (3), from which hydraulic medium is supplied from the channel (13).

9. Valve drive according to claim 7, wherein the housing (3) is screwed into the receptacle (1) of the cylinder head (2).

10. Hydraulically actuated variable valve drive of an internal-combustion engine, comprising a housing (3) installed in a receptacle (1) of a cylinder head (2), the housing includes a bore hole (4) in which an axially moveable slave piston (5) is located, the slave piston includes on one end (6) a pressure chamber (7) for the hydraulic medium and on an other end (8) has a hydraulic backlash compensation element (9) with a non-return valve (9*a*), the backlash compensation element (9) is adapted to act at least indirectly on a gas-exchange valve (11) on a side (10) of the compensation element away from the housing, wherein the housing (3) is sectioned by at least one path (12) for hydraulic medium, with the path being connected to a channel (13) of the slave piston (5) or the backlash compensation element (9) for further guidance of the hydraulic medium to a reservoir (14) of the backlash compensation element (9) directly in front of the non-return valve (9*a*), the housing (3) installed in the cylinder head (2) is produced as a separate component for forming only one slave unit (15), the channel (13) is connected hydraulically to the path (12) only outside of a stroke phase of the slave piston (5), the other end (8) of the slave piston (5) has a bore hole (25), in which a pressure piston (19) of the backlash compensation element (9) with non-return valve (9*a*) projecting from the bore hole (25) runs, a leakage slot (26) for the hydraulic medium is formed between the bore hole (25) and an outer casing of the pressure piston (19), and a feed line for the hydraulic medium to the non-return valve (9*a*) of the backlash compensation element (9) as a component of the channel (13) is applied in the slave piston (5), on an axial section above its bore hole (25), with the feed line having an inlet (30), which is in direct fluid connection with the path (12) at least outside of the stroke phase of the slave piston (5), radially outside on the slave piston (5).

11. Valve drive according to claim 10, wherein the section of the pressure piston (19) projecting from the bore hole (25) has a radial extension (31) comprising a securing ring or an annular shoulder, on which a compression spring (32) is supported, with the compression spring acting against the slave piston (5) on the other end.

12. Valve drive according to claim 10, wherein the path (12) opens into an annular groove (33) in the bore hole (4) of the housing (3), from which hydraulic medium is supplied from the channel (13).

* * * * *